US009179219B2

(12) United States Patent
Rolt

(10) Patent No.: US 9,179,219 B2
(45) Date of Patent: Nov. 3, 2015

(54) WIDEBEAM ACOUSTIC TRANSDUCER

(75) Inventor: Kenneth D. Rolt, Westford, MA (US)

(73) Assignee: Airmar Technology Corporation, Milford, NH (US)

( * ) Notice: Subject to any disclaimer, the term of this patent is extended or adjusted under 35 U.S.C. 154(b) by 665 days.

(21) Appl. No.: 13/292,424

(22) Filed: Nov. 9, 2011

(65) Prior Publication Data

US 2013/0114378 A1 May 9, 2013

(51) Int. Cl.
*H04R 17/00* (2006.01)
*B06B 1/06* (2006.01)

(52) U.S. Cl.
CPC ..... *H04R 17/00* (2013.01); *B06B 1/0611* (2013.01); *B06B 1/0655* (2013.01)

(58) Field of Classification Search
USPC ..... 367/157
See application file for complete search history.

(56) References Cited

U.S. PATENT DOCUMENTS

| | | | | |
|---|---|---|---|---|
| 1,828,705 | A | 5/1928 | Kolster | |
| 1,805,591 | A | 5/1931 | Ohl | |
| 2,430,013 | A | 6/1942 | Hansell | |
| 2,443,177 | A | 6/1948 | Beechlyn | |
| 2,657,319 | A | 6/1950 | Smack | |
| 3,359,537 | A * | 12/1967 | Geil et al. | 367/155 |
| 3,707,131 | A | 12/1972 | Massa | |
| 3,716,681 | A | 2/1973 | Barrow | |
| 3,849,679 | A | 11/1974 | Massa | |
| 4,204,281 | A | 5/1980 | Hagemann | |
| 4,333,028 | A | 6/1982 | Panton | |
| 4,644,787 | A | 2/1987 | Boucher | |
| 4,644,788 | A | 2/1987 | Boucher | |
| 4,768,615 | A | 9/1988 | Steinebrunner | |
| 5,218,575 | A | 6/1993 | Cherek | |
| 5,285,789 | A | 2/1994 | Chen | |
| 5,367,501 | A | 11/1994 | Kelly | |
| 5,389,848 | A | 2/1995 | Trzaskos | |
| 5,581,025 | A | 12/1996 | Boucher | |
| 5,673,236 | A * | 9/1997 | Barger | 367/157 |
| 5,719,824 | A | 2/1998 | Boucher | |
| 7,250,706 | B2 * | 7/2007 | Shiba | 310/325 |
| 7,457,198 | B2 * | 11/2008 | Stein et al. | 367/151 |
| 7,727,156 | B2 | 6/2010 | Angelsen | |
| 7,961,552 | B2 | 6/2011 | Boucher et al. | |
| 2006/0001334 | A1 * | 1/2006 | Shiba | 310/325 |
| 2006/0023570 | A1 * | 2/2006 | Betts et al. | 367/88 |
| 2007/0035204 | A1 * | 2/2007 | Angelsen et al. | 310/311 |
| 2010/0054084 | A1 * | 3/2010 | Boucher et al. | 367/118 |

FOREIGN PATENT DOCUMENTS

| | | |
|---|---|---|
| GB | 2 414 077 | 11/2005 |

OTHER PUBLICATIONS

P48W Sales brochure Dec. 15, 2010—Airmar Technology Corporation.

(Continued)

*Primary Examiner* — James Hulka
(74) *Attorney, Agent, or Firm* — Hamilton, Brook, Smith & Reynolds, P.C.

(57) ABSTRACT

An acoustic transducer for producing sonar waves features a piezoelectric structure with a radiating surface. A plurality of elements is attached to the radiating surface, and at least two of the plurality of elements have different acoustic properties. The acoustic transducer is designed for a wider beam angle for a thickness vibration mode while maintaining other desired vibration frequencies, maximum input power and low cost.

12 Claims, 6 Drawing Sheets

(56) References Cited

OTHER PUBLICATIONS

Owner's Guide and Installation Instructions 2008-2013—Airmar Technology Corporation dated Jan. 18, 2013.
P229 in *Principles and Applications of Underwater Sound*, Summary Technical Report of Division 6 (Sub Sea Warfare), vol. 7, National Defense Research Committee, Washington DC 1946. US Government Printing Office, and DTIC AD200786. (DTIC=Defense Technical Information Center, an office of the US Govt. see http://www.dtic.mil/dtic/) dated Sep. 30, 1946.
Page 143, *Principles and Applications of Underwater Sound*, National Defense Research Committee, vol. 7, Summary Technical Report of Division 6, Sub Sea Warfare, U.S. Government Printing Office (1946). AD 200786, available as a PDF file from DTIC dated Sep. 30, 1946.
Hülsmeyer's Telemobiloscope in 1904; http://www.design-technology.info/inventors/page28.htm downloaded Mar. 27, 2015.
http://en.wikipedia.org/wiki/Acoustic_mirror dated Feb. 17, 2015.
V.C. Anderson, Scripps Institute of Oceanography, SIO Ref 60-26, Jul. 1, 1960; https://escholarship.org/uc/item/9237d2nx.
Tate, John T., "Design and Construction of Crystal Transducers" In *Summary Technical Report of Division 6, NDRC*, National Defense Research Committee; vol. 12 (1946).
http://en.wikipedia.org/wild/Sombrero_function dated Jan. 31, 2015.
www.soundvet.com/library/media/pdf/THI_imaging.pdf downloaded Mar. 27, 2015.

* cited by examiner

WIDEBEAM ACOUSTIC TRANSDUCER

BACKGROUND

Sonar transducers are ideally designed for specific system needs such as beamwidth, useful range, impedance, and bandwidth. These designs are often revised based on the practical limits of available power, physical space, acoustic cavitation, thermal limits, mechanical stress, electrical stress and others. However, sometimes sonars are designed around existing legacy or low-cost hardware.

A specific example from the commercial marine industry is a piezoelectric transducer disk made of ceramic to produce sonar waves. These devices can provide dual sonar frequencies, relying on a lateral (radial) vibration mode for ~70-80 kHz and a thickness vibration mode for ~200 kHz. The thickness mode directly radiates sound, whereas the radial mode mechanically couples vibrations, in a Poisson sense, into a quasi-thickness direction, which in turn also radiates sound. This is one example, therefore, where a single transducer may be designed to produce two output frequencies, thus avoiding the expense of a second transducer.

In the commercial marine example, the −3 dB main-lobe beamwidth of the acoustic vibration beam produced at each frequency is primarily determined by the ratio of the acoustic wavelength and the outer diameter of the piezoelectric ceramic. The power input and output of such transducers is primarily limited by the volume of the piezoelectric ceramic, because such materials have a limited allowed energy density before a mechanical, thermal, electrical or combined failure occurs. For this specific example, the electrical driving power input limit is approximately 1.8 kW for a commonly used 25-mm-diameter by 9.5-mm-thick lead zirconate titanate (PZT) ceramic, and the beamwidths are typically 40 and 14 degrees, respectively, for ~75 kHz (lateral mode) and ~200 kHz (thickness mode) operation.

SUMMARY

A drawback of the commercial marine design example previously given is that it has a small beamwidth at the 200 kHz frequency. One way to increase the beamwidth is to decrease the piezoelectric structure diameter. However, decreasing the piezoelectric structure diameter increases the frequency of the lateral vibration mode. A higher-frequency lateral vibration mode is undesirable because higher acoustic frequencies are more attenuated in water. Decreasing the piezoelectric structure diameter also reduces the maximum input driving power, another unwanted side effect. Further, although acoustic lenses can also widen the beam, they involve engineering tradeoffs as to lens material, density, sound speed, and/or effects on transducer impedance and resonance frequencies of lateral and thickness vibration modes.

The present invention relates to acoustic transducer devices that can achieve greater beamwidths for a thickness vibration mode while maintaining desired dual frequencies, high maximum input power and low cost. Elements of differing acoustic properties are attached to a surface of a piezoelectric structure to change the phase of vibrational waves emanating from one attached element relative to the phase of vibrational waves emanating from another attached element, thus directing the beam over a wider angle. This increases the beamwidth without a need to decrease the piezoelectric structure size or use acoustic lenses.

In one aspect, an acoustic transducer for producing sonar waves includes a piezoelectric structure with a radiating surface. A plurality of elements is attached to the radiating surface, and at least two of the attached elements have differing acoustic properties.

In a second aspect, a sonar transducer includes a piezoelectric structure with a radiating surface. A first element with a first acoustic impedance is attached to the radiating surface, and a second element with a second acoustic impedance is also attached to the radiating surface in relation to the first element. In this aspect, the first acoustic impedance differs from the second acoustic impedance.

In a third aspect, a sonar transducer includes a piezoelectric structure with a radiating surface. The radiating surface can receive an inner disk and an outer washer. The inner disk is affixed to the radiating surface to be concentric with the radiating surface, and the inner disk includes an exterior disk perimeter. The outer washer is likewise affixed to the radiating surface to be concentric with the radiating surface. The outer washer has an inner washer perimeter configured to be contiguous with the exterior disk perimeter. The inner disk may be made of a plastic material, and the outer washer may be made of a synthetic rubberized cork material having a smaller acoustic impedance than the plastic material of the inner disk.

Embodiments of the acoustic transducer may also include a transducer housing for mounting the piezoelectric structure.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments of the invention follows.

The present invention relates to acoustic transducer devices for producing sonar waves. Acoustic transducers according to the invention can achieve greater beamwidths for a thickness vibration mode while maintaining desired dual frequencies, high maximum input power, and low cost.

According to embodiments within the scope of the invention, a plurality of elements is attached to a radiating surface of a piezoelectric structure, and at least two of the attached elements have differing acoustic properties. The attached elements may provide some impedance matching from the piezoelectric material to the water, as well as dissimilar acoustic radiated phase. In particular, the phase of vibrational waves emanating from one attached element is shifted relative to vibrational waves emanating from another attached element. The elements change the magnitude and phase of sound waves coupled from the piezoelectric structure, so the net sum of the waves in the far field is a beam pattern that is different in shape than radiated from a piezoelectric structure of the same diameter without such elements. This effect can widen the beam without decreasing the piezoelectric structure size or using acoustic lenses.

Figure 1:
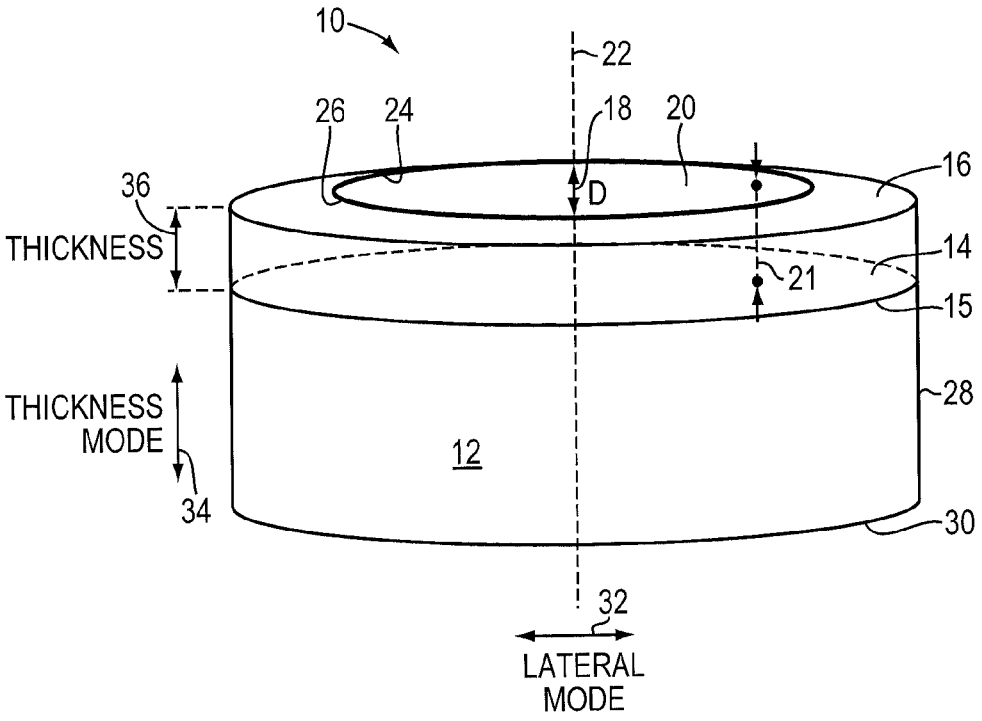
FIG. 1 shows an embodiment of an acoustic transducer, including a cylindrical piezoelectric structure, an inner round, and an outer annular ring.

FIG. 1 shows an embodiment of an example acoustic transducer 10. The piezoelectric structure is a cylindrical piezoelectric structure 12 with a flat radiating surface 14, circular perimeter 15 of the radiating surface 14, side surface 28 and bottom surface 30. One element is an inner round 20 with a diameter (D) 18, a round thickness 21, and a circular outer periphery 24 that is attached concentrically to radiating surface 14.

A second element is an outer annular ring 16 with a circular inner periphery 26 and ring thickness 36 that is also attached to the radiating surface to be concentric with it. In this embodiment, the radiating surface 14, inner round 20 and outer annular ring 16 share a common axis 22. The outer annular ring 16 may also be referred to as an annular layer or outer washer. The piezoelectric structure 12 has a lateral vibration mode 32 and a thickness vibration mode 34. Lateral vibration modes may also be referred to as radial vibration modes, particularly in the case of cylindrical piezoelectric structures such as cylindrical piezoelectric structure 12.

In an example embodiment, the piezoelectric structure may have a lateral vibration mode of approximately 70-80 kHz and a thickness vibration mode of approximately 200 kHz, as these are typical frequencies used in sonar for the commercial marine industry. Other example embodiments of the acoustic transducer may also have other lateral vibration and thickness vibration modes.

In acoustic transducer 10, the inner round 20 preferably comprises a plastic material, but this material may also be a hard plastic, a light metal or other material. The inner round 20 has a cylindrical shape and may also be referred to as an inner disk or a layer. However, in other embodiments this inner round may have other characteristics. For example, the inner round can have rounded edges instead of a flat top. The inner round can also have any other shape having curved side characteristics, such as an oval shape.

The shape of the inner round will affect its own sonar beam pattern. Ideal circular transducers have beam patterns with behavior defined by $2J_1(x)/x$, where $J_1$ is the Bessel function of the first kind and $x=\pi D \sin(\theta)/\lambda$, where D is the diameter, $\theta$ is the angle from the bore sight and $\lambda$ is the acoustic wavelength. Transducers comprised of annular rings will have a net beam pattern comprising a weighted superposition of $J_1$ patterns, where the weighting is the strength of each contribution. An oval shape will have a similar beam pattern, with more pattern asymmetry as the oval becomes more eccentric.

Embodiments of the invention include those having at least two elements with different acoustic properties. The acoustic property may be acoustic impedance, but it may also be another quality affecting acoustic behavior such as density, speed of sound, etc. The speed of sound of an element of a certain material, for example, is the speed at which sound waves of a particular frequency travel through the material. In the example of acoustic transducer 10, the acoustic impedance of the inner round 20 is preferably greater than the acoustic impedance of the outer annular ring 16. In other embodiments, however, the acoustic impedance of the inner round 20 may be smaller than the acoustic impedance of the outer annular ring 16.

The outer annular ring 16 in acoustic transducer 10 preferably comprises a synthetic rubberized cork (SRC) material. In other embodiments, the outer annular ring may comprise other materials such as synthetic foam, wood, composites, etc. If SRC were acoustically impenetrable by having an extremely small acoustic impedance, the product of the density and sound speed, it would act as an acoustic shield for a portion of the piezoelectric structure. However, in practice SRC has some acoustic impedance, so there is a component of the piezoelectric structure disk vibration that penetrates the SRC and thereby radiates sound.

A diameter of the inner round may be chosen initially so that:

$$(180/\pi)\times(\lambda/D)=W,$$

where $\lambda$ is a wavelength in water for acoustic waves of a frequency produced by the acoustic transducer, especially a thickness mode such as thickness vibration mode 34. W represents a desired acoustic beamwidth, in degrees, of an acoustic beam of the acoustic waves of the frequency produced by the acoustic transducer.

The round thickness 21 of the inner round is chosen to provide a low transmit quality factor Q, as it is known in the art of underwater acoustic transducer design. A low Q is usually achieved when the inner round has a thickness 21 approximately equal to ¼ wavelength of the acoustic waves of the thickness-mode frequency. For a 200 kHz thickness mode resonance, and a typical hard plastic with a bulk longitudinal wave speed of 2500 m/s, a round thickness 21 meeting the ¼ wavelength criterion is 3-4 mm. This quarter-wave method is commonly known as impedance matching in the art of wave mechanics, and it is well known in acoustics, optics and electromagnetics. An inner round 20 of hard plastic may not provide much impedance matching at the lateral mode of the piezoelectric structure, but it will not significantly impair the transducer performance for that mode.

The ring thickness 36 is a design variable and may be chosen so that sound radiation that penetrates the outer annular ring 16 is not in phase with sound radiation that penetrates the inner round 20. The ring thickness 36 may be the same as the round thickness 21, or these two thicknesses may be different. This illustrates the broader point that in some embodiments, at least two attached elements have the same thickness, but in other embodiments, all attached elements may have mutually different thicknesses.

The design geometric variables of thickness and diameter of the layers, as well as the design acoustic variables of sound speed, impedance and density, then are altered such that the desired beam pattern is obtained.

Other shapes of elements for attaching to the piezoelectric structure may be used, including oval, square, and also non-standard shapes. Further, non-contiguous elements are also within the scope of the invention. As an example, an embodiment may differ from acoustic transducer 10 in that the circular inner periphery 26 of the outer annular ring 16 may be larger in diameter that the circular outer periphery 24 of the inner round 20.

In the embodiment of FIG. 1, the elements, namely the outer annular ring 16 and the inner round 20, cover the radiating surface 14. In other embodiments, the elements do not completely cover the radiating surface.

Figure 2:
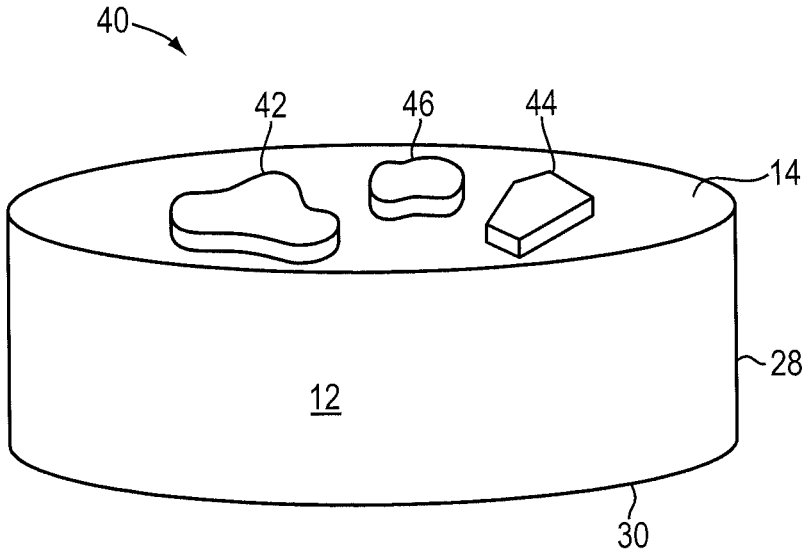
FIG. 2 shows a second embodiment with non-concentric, non-contiguous elements.

FIG. 2 shows a second embodiment of an acoustic transducer. There are multiple differences between acoustic transducer 40, as shown in FIG. 2, and acoustic transducer 10, as shown in FIG. 1. For example, acoustic transducer 40 has three elements attached to the piezoelectric structure 12, namely elements 42, 44, and 46, which are not concentric with piezoelectric structure 12. Further, they do not cover the entire radiating surface 14, nor are they contiguous with each other as in the acoustic transducer 10. The arrangement of FIG. 2 will produce a different beamwidth pattern that is less symmetric than the pattern produced by the example device of FIG. 1.

Figure 3:
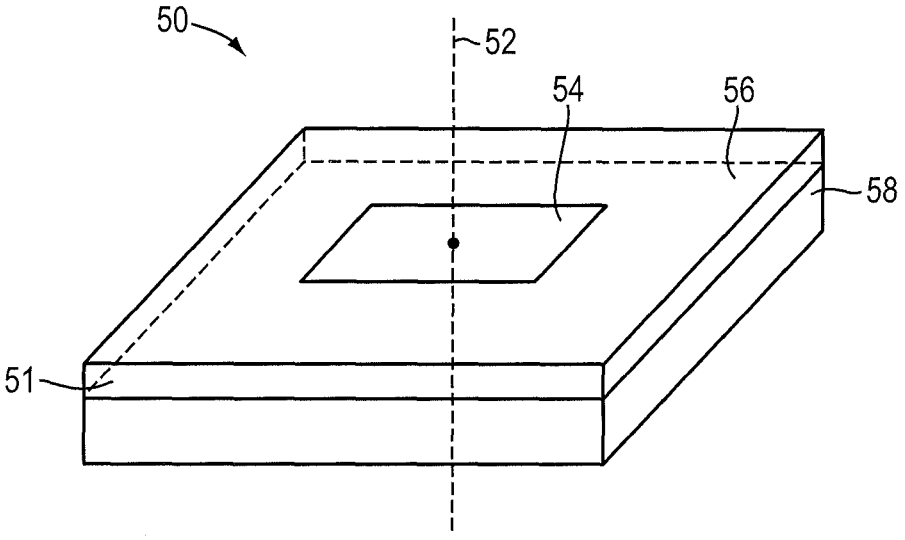
FIG. 3 shows a third embodiment with a piezoelectric structure and elements that are rectangular and coaxial.

FIG. 3 shows a third embodiment, a rectangular acoustic transducer 50. In the embodiment of FIG. 3, rectangular acoustic transducer 50 includes rectangular piezoelectric structure 58 having a rectangular radiating surface 51, a first rectangular element 54 and a second rectangular element 56. The rectangular radiating surface 51, the first rectangular element 54 and the second rectangular element 56 are coaxial, sharing an axis 52. However, in other embodiments, some or all elements need not be coaxial.

The beam pattern of a rectangular shape differs from that of a circular shape. The circular transducer has a beam pattern defined by $2J_1(x)/x$, as noted above. The rectangular transducer has a beam pattern defined by sin(x)/x. Transducers comprised of coaxial rectangular elements, such elements 54, 56 shown in FIG. 3, will have a net beam pattern comprising a weighted superposition of sin(x)/x patterns.

Figure 4A:
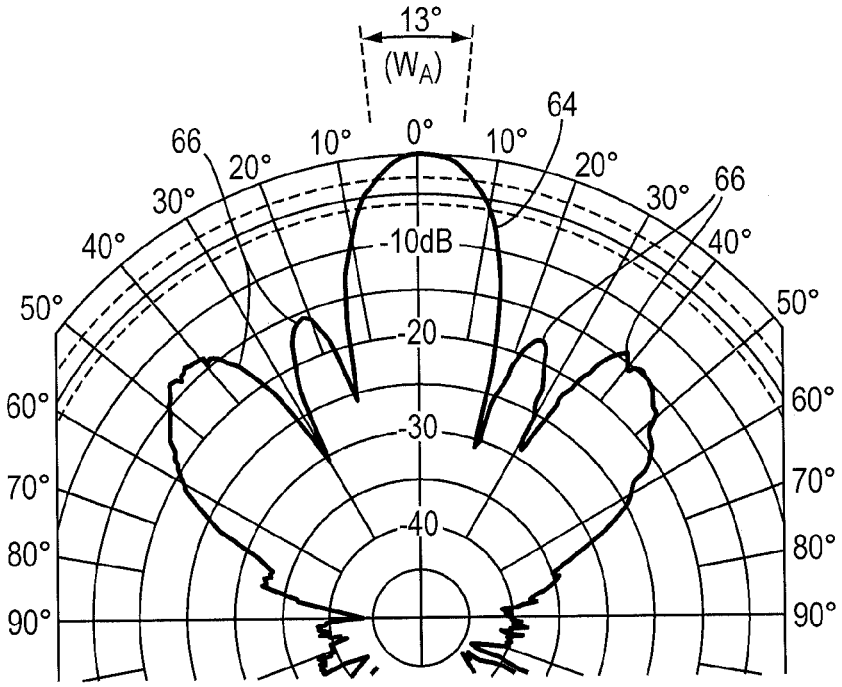
FIG. 4A shows a measured beam directivity pattern for a known acoustic transducer.

FIG. 4A shows a measured beam directivity pattern, or beam pattern, for a known acoustic transducer. The beam directivity pattern shown is for a 9.5 mm thick lead zirconate titanate ceramic piezoelectric structure of 27 mm diameter operating at approximately 200 kHz. This beam directivity pattern includes a main lobe 64 and side lobes 66 at the 200 kHz frequency. This known device lacks the plurality of elements as disclosed herein, and it results in a measured −3 dB main-lobe beamwidth ($W_A$) of 13 degrees, as indicated in the figure.

Figure 4B:
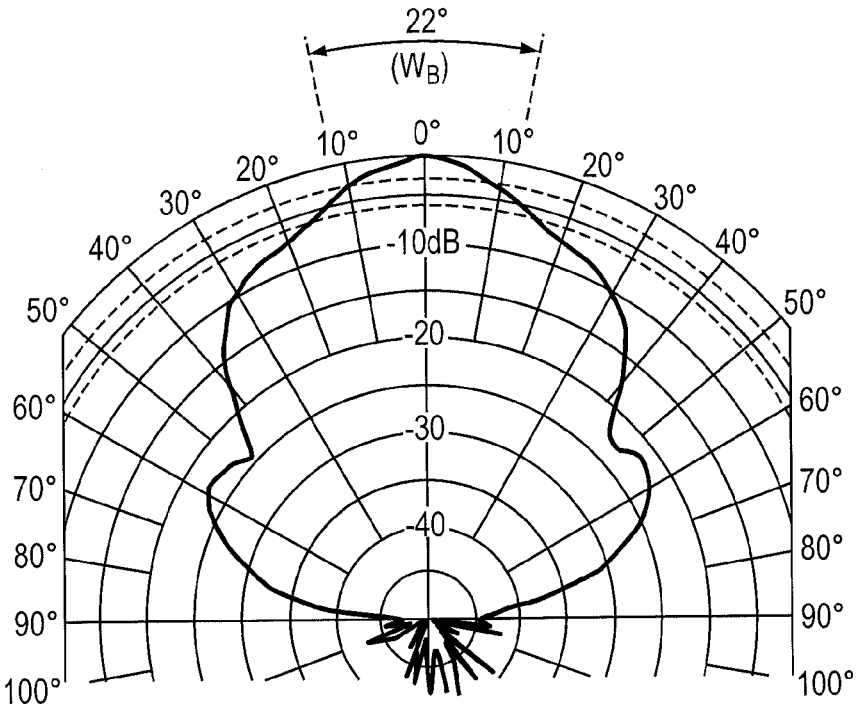
FIG. 4B shows a measured beam directivity pattern for an example acoustic transducer in accordance with the embodiment shown in FIG. 1.

FIG. 4B, in contrast to FIG. 4A, shows a measured beam directivity pattern for a sample device according to the embodiment shown in FIG. 1. Here, a plastic inner round (23 mm diameter) and an outer annular ring (27 mm outer diameter and 23 mm inner diameter) are attached to a piezoelectric structure having the same specifications as those of FIG. 4A. The acoustic main and side lobes from each concentric element combine coherently to synthesize a total radiated pattern that is wider than obtained in the absence of the attached elements. Thus, in FIG. 4B, the measured −3 dB main-lobe beamwidth ($W_B$) is 22 degrees, in contrast to the measured 13 degrees in FIG. 4A. The greater beamwidth ($W_B$) in FIG. 4B illustrates a benefit that may be obtained using embodiments of the present invention.

Figure 5:
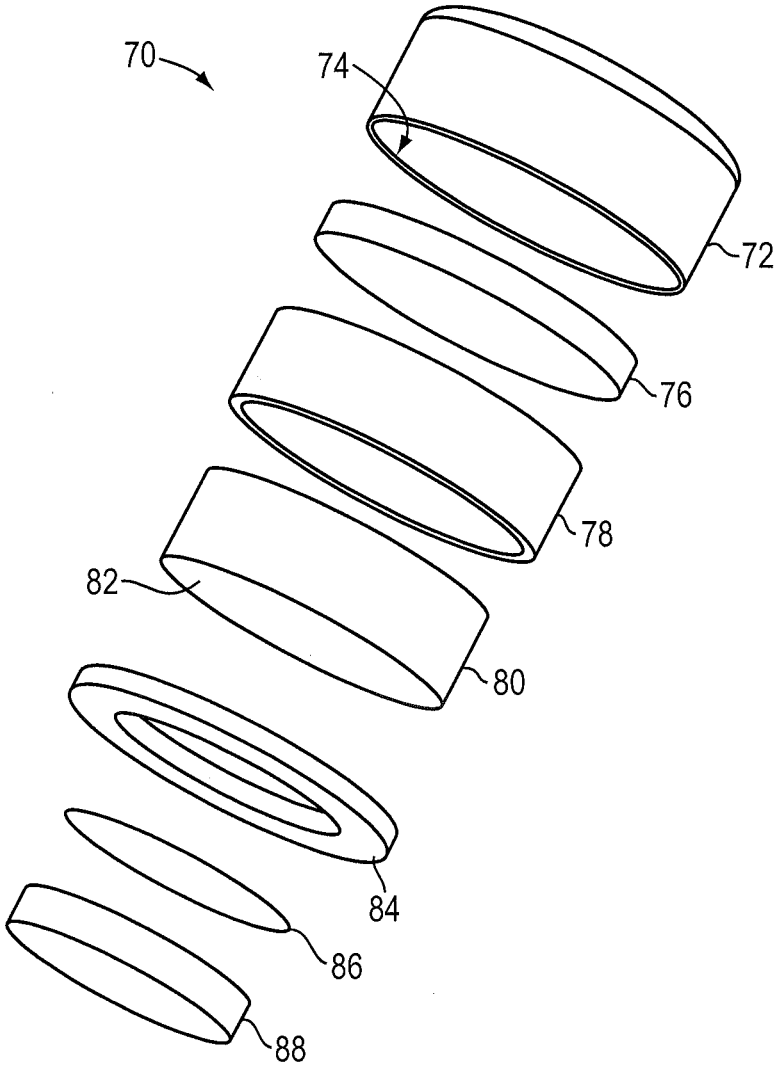
FIG. 5 is an exploded view of an acoustic transducer assembly in accordance with the acoustic transducer shown in FIG. 1.

FIG. 5 is an exploded view of an embodiment of an acoustic transducer assembly 70. The acoustic transducer assembly 70 comprises a transducer housing 72 with an inner housing wall 74, a foam backing 76, a cylindrical SRC jacket 78, a piezoelectric structure 80 with a radiating surface 82, an outer annular ring 84, an adhesive layer 86 and an inner round 88.

In the embodiment shown in FIG. 5, the foam backing 76 is placed inside the transducer housing 72 between the transducer housing 72 and the piezoelectric structure 80. The cylindrical SRC jacket 78 is positioned around the piezoelectric structure 80 to be between the piezoelectric structure 80 and the inner housing wall 74 of the transducer housing 72. The outer annular ring 84 is positioned on the radiating surface 82, concentric with the radiating surface 82. The inner round 88 is also attached to the radiating surface 82, with the adhesive layer 86 positioned between the radiating surface 82 and the inner round 88. The entire acoustic transducer assembly 70 may be coated with an acoustically transparent waterproof encapsulant material (not shown).

Figure 6:
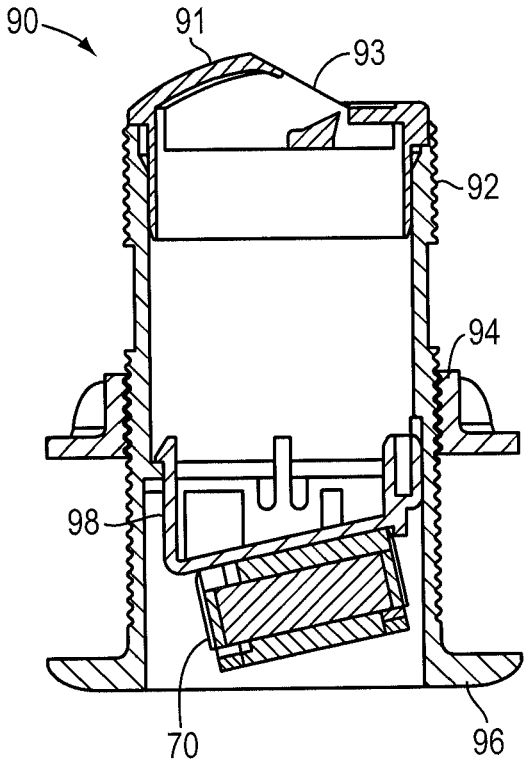
FIG. 6 is a cross-sectional view of an acoustic transducer assembly in accordance with FIG. 5 mounted in a through-hull housing.

FIG. 6 is a cross-sectional view of a through-hull mount assembly 90, where the assembly is mounted in a hole through a boat hull. The mount assembly 90 includes acoustic transducer assembly 70 in accordance with the embodiment of FIG. 5 mounted in a through-hull housing 92 designed to protrude through a hull of a boat. FIG. 6 shows the transducer assembly 70 mounted to form a 70 degree angle with respect to the horizontal water surface and 20 degrees with respect to the angle between the transducer assembly bore sight and the direction to the lake/ocean bottom. However, the bore sight angle from the bottom may vary from 0 to 20 degrees in other embodiments. A cap 91 covers the top of the housing 92, except for a cable opening 93. Once the housing 92 has been inserted into a hole through the exterior of the boat hull, flange nut 94 may be screwed onto housing 92 to push against the interior of the boat hull and simultaneously pull flange lip 96 against the exterior of the boat hull to fasten the mount assembly 90 to the boat hull. The interior of the mount assembly 90 includes a ceramic holder 98 to which the acoustic transducer assembly 70 is mounted. While a through-hull assembly is shown in FIG. 6, it should be understood that other mounting arrangements are contemplated, such as transom-mount, trolling-motor-mount, and portable-mount designs.

While this invention has been particularly shown and described with references to example embodiments thereof, it will be understood by those skilled in the art that various changes in form and details may be made therein without departing from the scope of the invention encompassed by the appended claims.

What is claimed is:

1. An acoustic transducer for producing sonar waves, the acoustic transducer comprising:

a piezoelectric structure with a radiating surface; and a plurality of elements attached to the radiating surface, the plurality of elements comprising at least two elements including an outer annular ring and an inner round disk within an inner perimeter of the ring, the ring and disk of differing acoustic properties and configured to permit penetration of acoustic waves therethrough, the piezoelectric structure and plurality of attached elements configured to produce an acoustic beam defined by one or more first order Bessel functions of the first kind.

2. The acoustic transducer of claim 1, wherein the radiating surface has a circular perimeter and the plurality of elements comprises elements that are attached to the radiating surface concentric with the circular perimeter.

3. The acoustic transducer of claim 1, wherein the outer annular ring comprises a synthetic rubberized cork material.

4. The acoustic transducer of claim 1, wherein the inner round disk comprises a plastic material.

5. The acoustic transducer of claim 1, wherein a diameter D of the inner round disk is chosen so that $(180/\pi)\times(\lambda/D)=W$, where $\lambda$ is a wavelength in water for acoustic waves of a frequency produced by the acoustic transducer and W is a desired acoustic beamwidth, in degrees, of the acoustic beam of the acoustic waves of the frequency produced by the acoustic transducer.

6. The acoustic transducer of claim 1, wherein at least two elements of the plurality of elements are contiguous with each other.

7. The acoustic transducer of claim 6, wherein the plurality of elements attached to the radiating surface cover the radiating surface.

8. The acoustic transducer of claim 1, wherein sound waves of a frequency produced by the acoustic transducer travel at different speeds in the at least two elements of differing acoustic properties.

9. The acoustic transducer of claim 1, wherein at least two of the plurality of elements attached to the radiating surface are of the same thickness.

10. The acoustic transducer of claim 1, wherein the radiating surface is rectangular.

11. The acoustic transducer of claim 1, wherein at least one of the plurality of elements attached to the radiating surface is coaxial with the radiating surface.

12. The acoustic transducer of claim 1, wherein the acoustic beam includes sonar waves of dual frequencies.

* * * * *